US007453329B2

(12) United States Patent
Inoue

(10) Patent No.: US 7,453,329 B2
(45) Date of Patent: Nov. 18, 2008

(54) VARIABLE ATTENUATOR AND INTEGRATED CIRCUIT

(75) Inventor: Yusuke Inoue, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/902,065

(22) Filed: Sep. 18, 2007

(65) Prior Publication Data

US 2008/0032653 A1 Feb. 7, 2008

Related U.S. Application Data

(63) Continuation of application No. PCT/JP2005/004986, filed on Mar. 18, 2005.

(51) Int. Cl.
*H01P 1/22* (2006.01)

(52) U.S. Cl. ..... 333/81 A

(58) Field of Classification Search ..... 333/81 A, 333/81 R, 28 R, 156, 161, 33; 327/308
See application file for complete search history.

(56) References Cited

U.S. PATENT DOCUMENTS

| | | | | |
|---|---|---|---|---|
| 4,754,240 | A * | 6/1988 | Marconi | 333/81 A |
| 4,837,530 | A * | 6/1989 | Kondoh | 333/81 A |
| 6,522,221 | B1 | 2/2003 | Hayashi | |

FOREIGN PATENT DOCUMENTS

| | | | |
|---|---|---|---|
| JP | 57-044314 | A | 3/1982 |
| JP | 59-61603 | U | 4/1984 |
| JP | 61-139110 | A | 6/1986 |
| JP | 61-198801 | A | 9/1986 |
| JP | 62-230101 | A | 10/1987 |
| JP | 63-99401 | U | 6/1988 |
| JP | 6-112767 | A | 4/1994 |
| JP | 8-181508 | A | 7/1996 |
| JP | 11-317605 | A | 11/1999 |
| JP | 2000-101381 | A | 4/2000 |
| JP | 2000-286659 | A | 10/2000 |
| JP | 2001-284539 | A | 10/2001 |
| JP | 3347705 | B2 | 9/2002 |

* cited by examiner

*Primary Examiner*—Stephen E Jones
(74) *Attorney, Agent, or Firm*—Arent Fox LLP

(57) ABSTRACT

In a variable attenuator attenuating a signal inputted to an input terminal from a plurality of transmission lines connected in series between the input terminal and an output terminal and outputting the signal from the output terminal, first and second resistance elements to improve an input/output characteristic are connected in parallel respectively to the transmission line connected to the input terminal and the transmission line connected to the output terminal, so that reflection in input/output is sustained by the first and second resistance elements, to obtain a good input/output characteristic, and so that an impedance in a signal line is increased at a time of maximum attenuation without being suppressed by the first and second resistance elements, to obtain a large attenuation amount.

10 Claims, 7 Drawing Sheets

| | HIGH FREQUENCY OPERATION | HIGH WITHSTAND VOLTAGE OPERATION |
|---|---|---|
| InP HEMT | ○ | × |
| InP HBT | ○ | △ |
| SiGe HBT | ○ | △ |
| CMOS | △ | × |
| GaN HEMT | △ | ○ |
| GaAs pHEMT | △ | △ |

VARIABLE ATTENUATOR AND INTEGRATED CIRCUIT

CROSS-REFERENCE TO RELATED APPLICATION

This application is a Continuation of International Application No. PCT/JP2005/004986, filed Mar. 18, 2005, the entire specification claims and drawings of which are incorporated herewith by reference.

TECHNICAL FIELD

The present invention relates to a variable attenuator having a broadband characteristic and an integrated circuit using the same.

BACKGROUND ART

With the growth of highly sophisticated information society, development of a microwave band is promoted and demand for highly sophisticated microwave components is increasing. As one of the above, there is a broadband variable attenuator which has a broad band in a high-frequency range and of which an attenuation amount is adjustable.

For example, as a broadband variable attenuator used in a microwave band, there are known a T-variable attenuator constituted by connecting field effect transistors (FETs) in T-shape and a π-variable attenuator constituted by connecting field effect transistors (FETs) connected in π-shape. Further, a variable attenuator is suggested in which switching between T-shape and π-shape is possible by controlling a gate voltage of the FET and so forth (for example, see Japanese Patent Application Laid-open No. Hei 6-112767).

For the broadband variable attenuator, a good input/output characteristic and a large attenuation amount are required. However, in a conventional broadband variable attenuator, it is quite difficult to simultaneously obtain two characteristics of the good input/output characteristic and the large attenuation amount.

FIG. 10 is a diagram showing a circuitry of a conventional variable attenuator. A variable attenuator 100 includes transmission lines 3*a*, 3*b*, 3*c*, and 3*d* connected in series between an input terminal 1 and an output terminal 2. The transmission lines 3*a* to 3*d* are transmission lines whose line lengths are quarter wavelength (λ/4).

Also, the variable attenuator 100 includes FETs 4*a*, 4*b*, and 4*c* functioning as variable resistance elements and adjusting an impedance (alternating-current resistance) in the variable attenuator 100, that is, an attenuation amount by the variable attenuator 100. The FETs 4*a* to 4*c* are provided in a manner to correspond to respective interconnection points (between 3*a*-3*b*, between 3*b*-3*c*, and between 3*c*-3*d*) of the transmission lines.

Drains of the FETs 4*a*, 4*c* are connected to the interconnection points between the transmission lines 3*a*-3*b* and 3*c*-3*d* via resistance elements 101, 102. A drain of the FET 4*b* is connected to the interconnection point between the transmission lines 3*b*-3*c*. Sources of the FETs 4*a* to 4*c* are connected to the ground (are earthed). Gates of the FETs 4*a* to 4*c* are connected to a control terminal 6 via resistance elements 5*a* to 5*c* respectively.

The resistance elements 101, 102 are interposed in order that an input/output reflection characteristic is improved to obtain a good input/output characteristic in the variable attenuator 100. Resistance values (impedances) thereof are Z0 (for example, about 50 ohm, respectively).

FIG. 11 is a diagram showing an equivalent circuit at a time of maximum attenuation of the conventional variable attenuator 100 shown in FIG. 10. At the time of maximum attenuation, the FETs 4*a* to 4*c* are turned on by control voltage supplied via the control terminal 6 (assume that on-resistance values are RON).

On this occasion, as shown in FIG. 11, in addition to the on-resistance values RON of the FETs, the resistance values Z0 of the resistance elements 101, 102 are applied to between a signal line constituted with the transmission lines 3*a* to 3*d* and the ground. Accordingly, in the signal line, the impedance from a viewpoint of a node N11 becomes large enough, but the impedance from a viewpoint of a node N12 does not become large because of an influence of the resistance element 102, and so the attenuation amount cannot be made sufficiently large.

In other words, as shown in FIG. 10, when the variable attenuator is constituted in a manner that the resistance element is interposed in series between the signal line and the ground for the sake of acquisition of the good input/output characteristic, the interposed resistance element suppresses increase of the impedance in the signal line. As a result, the attenuation amount (attenuation capability) in the variable attenuator is deteriorated and a large attenuation amount cannot be obtained.

SUMMARY OF THE INVENTION

A variable attenuator of the present invention includes a plurality of transmission lines connected in series between an input terminal and an output terminal, and first and second resistance elements to improve an input/output characteristic. Further, the first resistance element is connected in parallel to the transmission line connected to the input terminal while the second resistance element is connected in parallel to the transmission line connected to the output terminal.

DETAILED DESCRIPTION OF THE PREFERRED EMBODIMENTS

Hereinafter, an embodiment of the present invention will be described with reference to the drawings.

Figure 1:
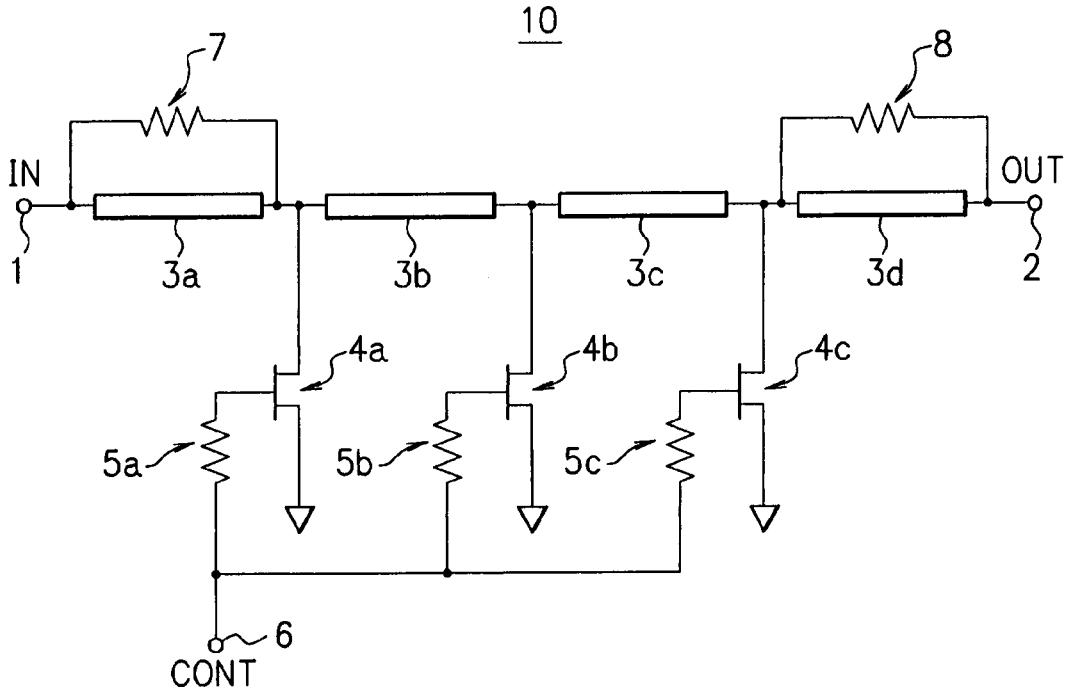
FIG. 1 is a diagram showing a circuitry example of a variable attenuator according to an embodiment of the present invention.

FIG. 1 is a diagram showing a circuitry example of a variable attenuator according to an embodiment of the present invention. A variable attenuator 10 according to the present embodiment is a broadband variable attenuator which has a characteristic of broadband in a high-frequency region and in which an attenuation amount is adjustable, and includes transmission lines 3*a*, 3*b*, 3*c* and 3*d*, field effect transistors (FETs) 4*a*, 4*b* and 4*c*, and resistance elements 7,8, as shown in FIG. 1.

A plurality of the transmission lines 3*a* to 3*d* are connected in series between an input terminal (IN) 1 to which a signal is inputted and an output terminal (OUT) 2 from which the signal which is attenuated is outputted. The transmission lines 3*a* to 3*d* respectively have line lengths (electric lengths) of quarter wavelength (λ/4), and in each of the transmission lines 3*a* to 3*d* it is configured so that a component reflected at an input end and a component transmitted through the transmission line and reflected at an output end cancel each other to eliminate reflection apparently.

Further, the FETs 4*a* to 4*c* are provided in correspondence with respective interconnection points of the transmission lines 3*a* to 3*d*. Betweenness of drains and sources of the respective FETs 4*a* to 4*c* are connected to between the interconnection points of the transmission lines 3*a* to 3*d* and the ground (earth) in series.

Specifically, the drain of the FET 4*a* is connected to the interconnection point of the transmission lines 3*a*, 3*b*. The source of the FET 4*a* is connected to the ground (is earthed). The drain of the FET 4*b* is connected to the interconnection point of the transmission lines 3*b*, 3*c*. The drain of the FET 4*c* is connected to the interconnection point of the transmission lines 3*c*, 3*d*. The sources of the FETs 4*b*, 4*c* are connected to the ground. The gates of the FETs 4*a* to 4*c* are connected to a control terminal (CONT) 6 from which control voltage is supplied, via resistance elements 5*a* to 5*c* respectively. In correspondence with the control voltage supplied from this control terminal 6, resistance values of the FETs 4*a* to 4*c* are controlled.

In other words, the FETs 4*a* to 4*c* are connected in series to between the interconnection points of the transmission lines 3*a* to 3*d* and the ground and function as variable resistance elements for adjusting an impedance in the variable attenuator 10, that is, an attenuation amount of a signal by the variable attenuator 10. It should be noted that, in the present embodiment, there is described a case that the FET is used as the variable resistance element for adjusting the attenuation amount of the signal in the variable attenuator 10 as an example, but any variable resistance element capable of adjusting a resistance value electrically can be used and the present embodiment is not limited thereto.

The resistance elements 7, 8 are for obtaining matching of input and output to improve an input/output reflection characteristic, and resistance values (impedances) thereof are Z0 (for example, about 50 ohm respectively). The resistance element 7 is connected in parallel to the transmission line 3*a* whose one end is connected to the input terminal 1, while the resistance element 8 is connected in parallel to the transmission line 3*d* whose one end is connected to the output terminal 2.

To be more precise, one end of the resistance element 7 is connected to an interconnection point of the input terminal 1 and the transmission line 3*a*. The other end of the resistance element 7 is connected to the interconnection point of the transmission lines 3*a* and 3*b*. One end of the resistance element 8 is connected to the interconnection point of the transmission lines 3*c* and 3*d*. The other end of the resistance element 8 is connected to an interconnection point of the transmission line 3*d* and the output terminal 2.

In the variable attenuator 10 shown in FIG. 1, by controlling resistance values of the FETs 4*a* to 4*c* based on gate voltage (control voltage) of the FETs 4*a* to 4*c* applied from the control terminal 6, the impedance of a signal line in the variable attenuator 10 is adjusted. In other words, in the variable attenuator 10, the attenuation amount in the variable attenuator 10 is controlled by the control voltage applied from the control terminal 6 so that the signal is attenuated by a desired attenuation amount, and the signal inputted from the input terminal 1 is attenuated and outputted from the output terminal 2.

Figure 2:
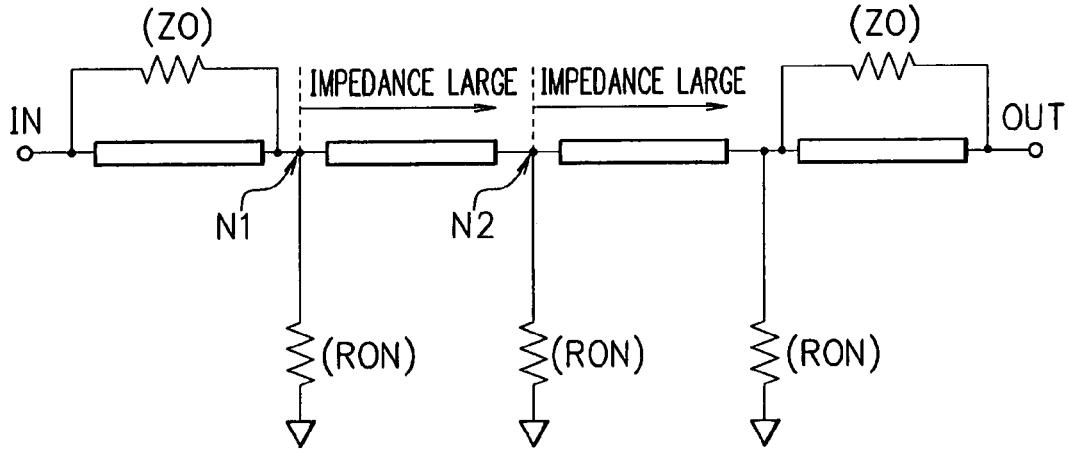
FIG. 2 is an equivalent circuit diagram at a time of maximum attenuation of the variable attenuator shown in FIG. 1.

Next, a circuit function at the time of maximum attenuation of the variable attenuator 10 according to the present embodiment will be described. FIG. 2 is a diagram showing an equivalent circuit at the time of maximum attenuation of the variable attenuator 10 shown in FIG. 1. In the variable attenuator 10, at the time of maximum attenuation, the FETs 4*a* to 4*c* are turned on by the control voltage applied from the control terminal 6, and the resistance values (on-resistances) thereof become RON.

Figure 10:
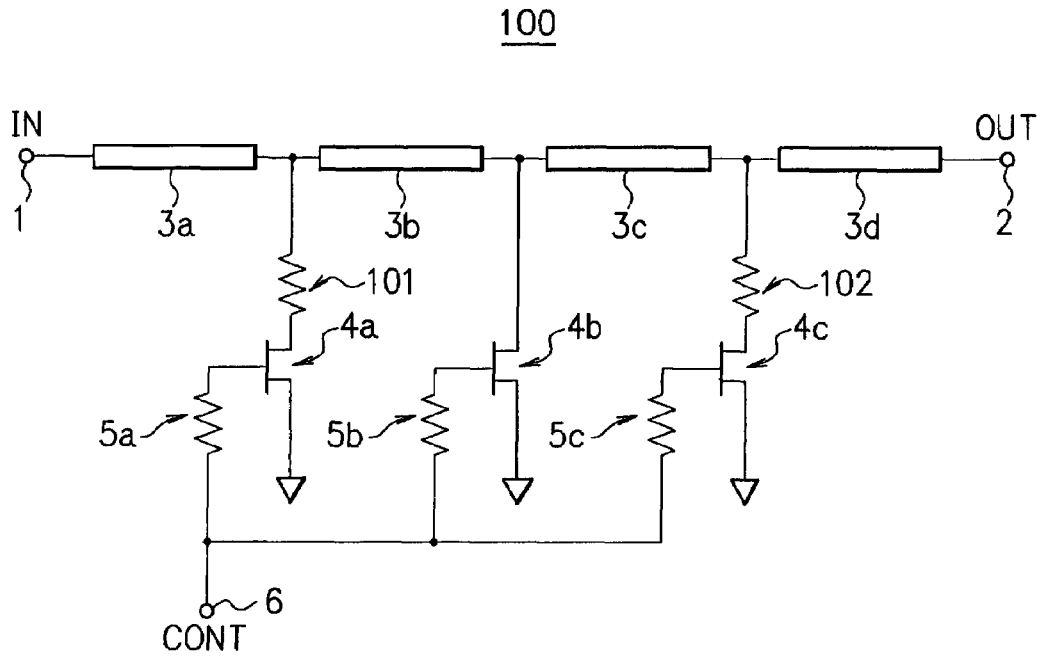
FIG. 10 is a diagram showing a circuitry of the conventional variable attenuator.
Figure 11:
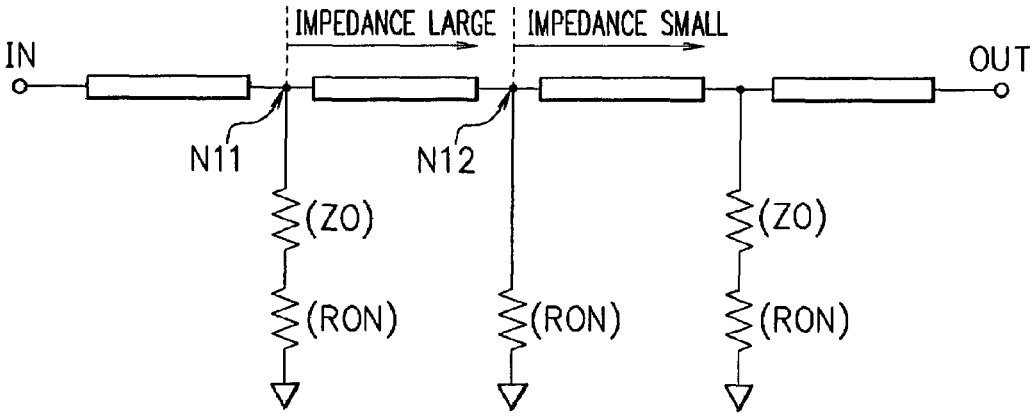
FIG. 11 is an equivalent circuit diagram at a time of maximum attenuation of the conventional variable attenuator shown in FIG. 10.

At this time of maximum attenuation, unlike in the conventional variable attenuator 100 shown in FIG. 10 and FIG. 11, in the variable attenuator 10 according to the present embodiment, the impedance between the signal line constituted with the transmission lines 3*a* to 3*d* and the ground is only the on-resistances RON of the FETs as shown in FIG. 2.

Hereby, by providing the resistance elements 7, 8 to improve the input/output characteristic, a good input/output characteristic is obtained, and it becomes possible to make both of the impedance from a viewpoint of the node N1 and the impedance from a viewpoint of the node N2 in the signal line large enough regardless of the resistance elements 7, 8. Therefore, in the variable attenuator 10, it is possible to improve the maximum attenuation amount than conventionally possible, without deteriorating the input/output characteristic.

Next, respective characteristics of the variable attenuator according to the present embodiment as shown in FIG. 1 will be described.

Figure 3A:
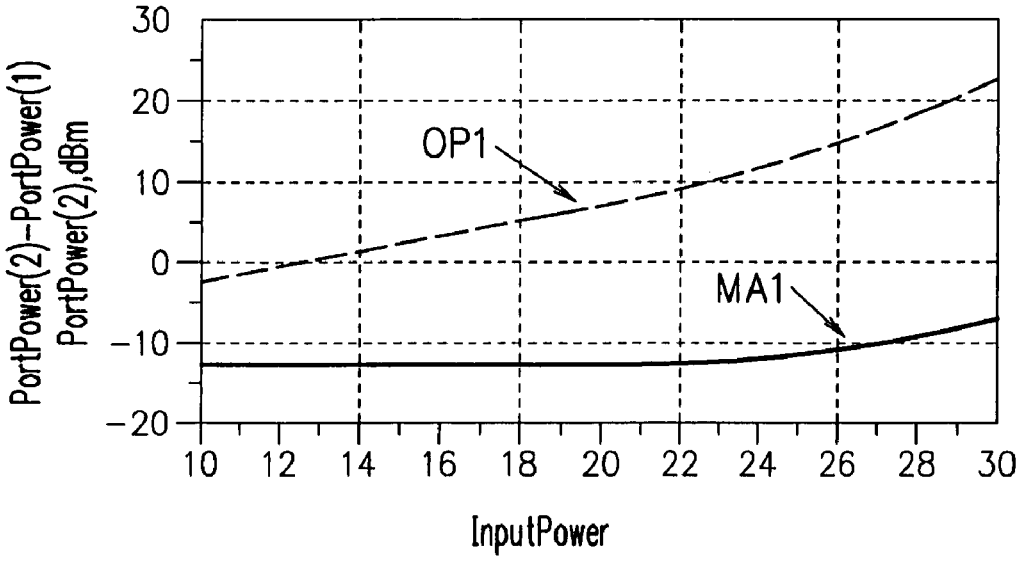
FIG. 3A is a graph showing a characteristic (maximum attenuation amount) of the variable attenuator according to the present embodiment.

First, an attenuation characteristic (maximum attenuation characteristic) in a microwave band (frequency is 3 GHz, for example) will be described with reference to FIG. 3A and FIG. 3B. FIG. 3A is a graph showing a characteristic (maximum attenuation amount) of the variable attenuator according to the present embodiment, while FIG. 3B is a graph showing a characteristic (maximum attenuation amount) of the conventional variable attenuator for the sake of comparison.

Figure 3B:
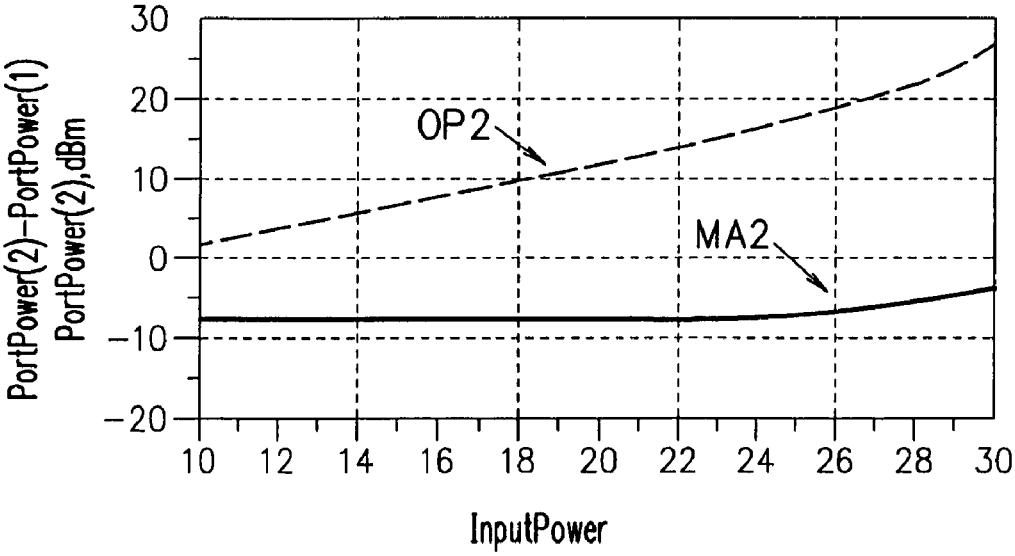
FIG. 3B is a graph showing a characteristic (maximum attenuation amount) of a conventional variable attenuator.

In FIG. 3A and FIG. 3B, horizontal axes indicate input powers of signals, while vertical axes indicate output powers of the signals and attenuation amounts (differences of the output powers and the input powers). In FIG. 3A, a reference numeral OP1 denotes the output power corresponding to the input power while a reference numeral MA1 denotes the maximum attenuation amount corresponding to the input power. Similarly, in FIG. 3B, reference numerals OP2 and MA2 denote the output power corresponding to the input power and the maximum attenuation amount respectively.

As is obvious from FIG. 3A and FIG. 3B, the maximum attenuation amount (about −12 dB) of the variable attenuator according to the present embodiment is larger than the maximum attenuation amount (about −8 dB) of the conventional variable attenuator regardless of the input powers of the signals, the maximum attenuation amount of the variable attenuator being improved.

Figure 4A:
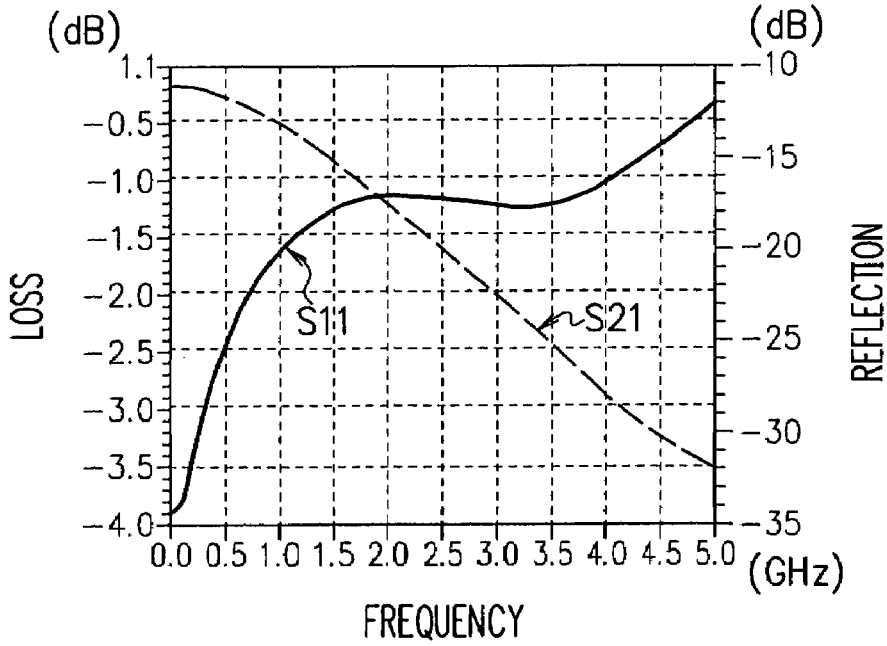
FIG. 4A is a graph showing a reflection characteristic (at a time of minimum attenuation) of the variable attenuator according to the present embodiment.
Figure 4B:
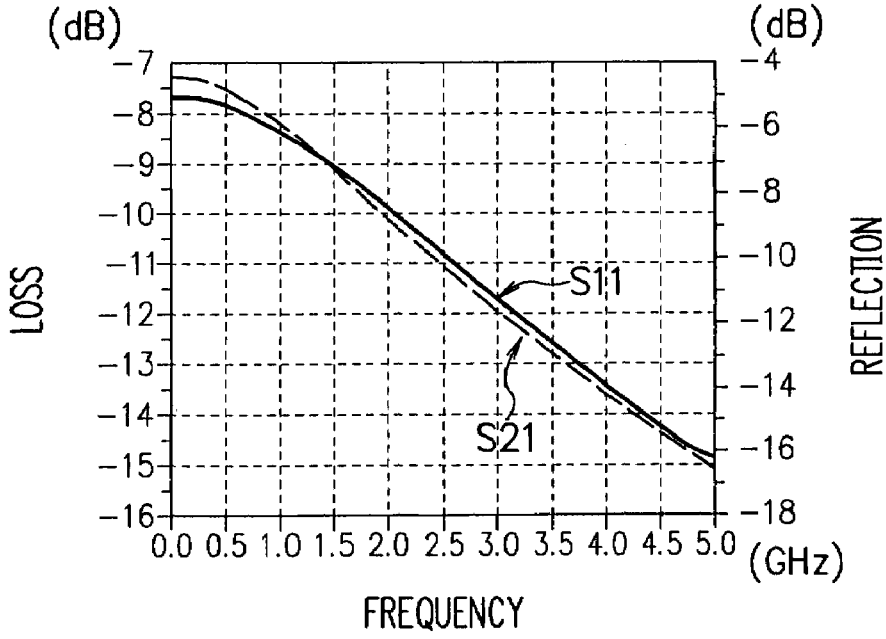
FIG. 4B is a graph showing the reflection characteristic (at a time of maximum attenuation) of the variable attenuator according to the present embodiment.

Next, a reflection characteristic of the variable attenuator according to the present embodiment will be described with reference to FIG. 4A and FIG. 4B. FIG. 4A and FIG. 4B are graphs showing the reflection characteristic of the variable attenuator according to the present embodiment, a case of a minimum attenuation time being shown in FIG. 4A and a case of a maximum attenuation time being shown in FIG. 4B.

In FIG. 4A and FIG. 4B, horizontal axes indicate frequencies of signals, while vertical axes indicate reflection amounts (right axes) and loss amounts (left axes). In FIG. 4A and FIG. 4B, reference numerals S11 denote the reflection amounts and reference numerals S21 denote the loss amounts.

As shown in FIG. 4A and FIG. 4B, it is realized that, in the variable attenuator according to the present embodiment, reflection amounts are small in both the minimum attenuation time and the maximum attenuation time, and that the good input/output characteristic is obtained. Further, for the variable attenuator, it is generally considered to be desirable that the reflection amount is (−10 dB) or less, and the variable attenuator according to the present embodiment has a very good input/output characteristic, the reflection amount being (−10 dB) or less in the microwave band (about 3 GHz or more).

Figure 5:
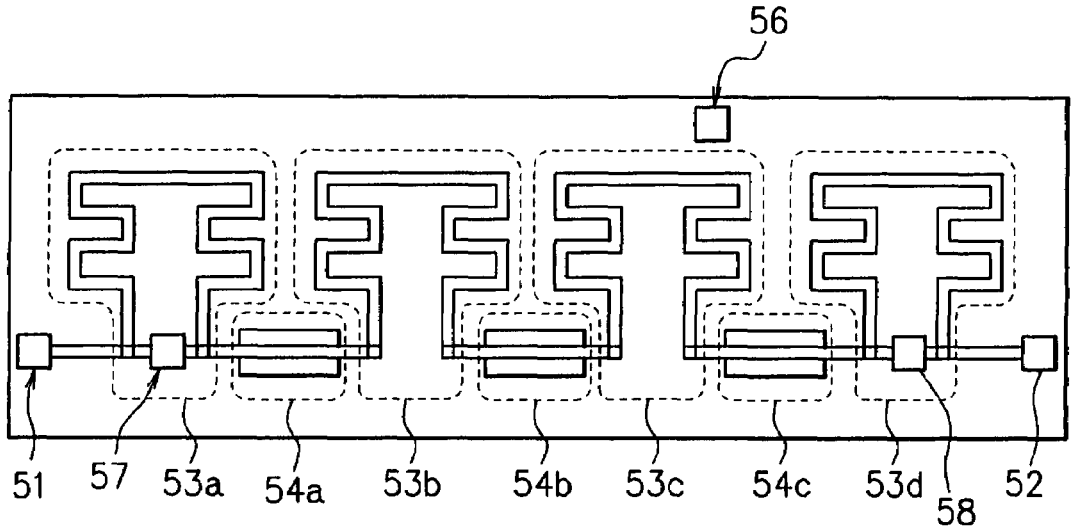
FIG. 5 is a diagram showing a layout example of the variable attenuator according to the present embodiment.

FIG. 5 is a diagram showing a layout example of the variable attenuator according to the present embodiment.

In FIG. 5, a reference numeral 51 denotes an input terminal, a reference numeral 52 denotes an output terminal, and a reference numeral 56 denotes a control terminal, and they respectively correspond to the input terminal 1, the output terminal 2, and the control terminal 6 shown in FIG. 1. Reference numerals 53*a* to 53*d* denote quarter wavelength transmission lines and correspond to the transmission lines 3*a* to 3*d* shown in FIG. 1.

Reference numerals 54*a* to 54*c* denote FETs and correspond to the FETs 4*a* to 4*c* shown in FIG. 1. As the FETs 54*a* to 54*c*, there are applied high electron mobility transistors (HEMTs) using gallium nitride (GaN), for example. Also, as will be described later, hetero-junction bipolar transistors (HBTs) can be applied as the FETs 54*a* to 54*c*.

Reference numerals 57 and 58 denote resistances having resistance values of 50 ohm and correspond to the resistance elements 7, 8 shown in FIG. 1. It should be noted that in FIG. 5 wirings and the like between gates of the FETs 54*a* to 54*c* and the control terminal 56 are omitted and not shown.

Figure 6:
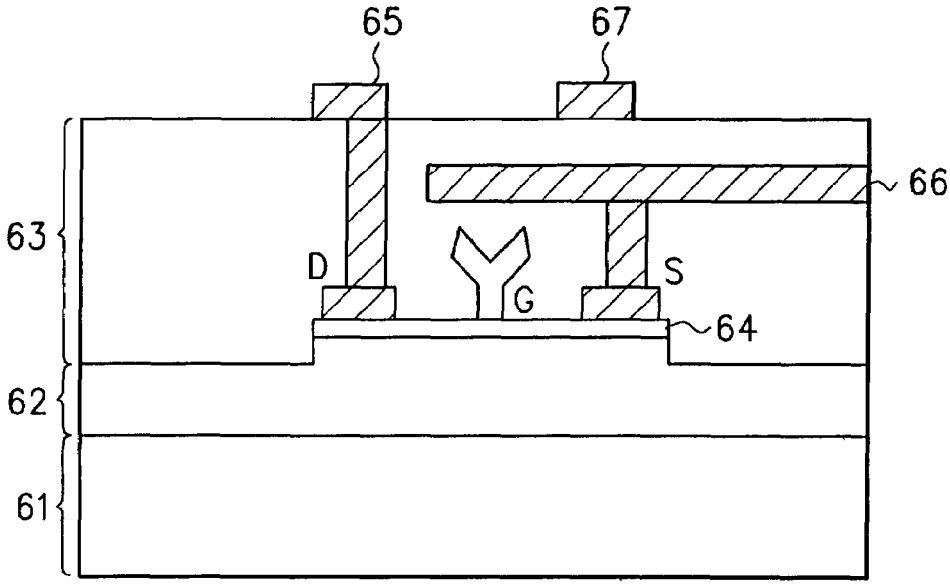
FIG. 6 is a cross-sectional view schematically showing a configuration example of an integrated circuit capable of constituting the variable attenuator according to the present embodiment.

Here, the above-described variable attenuator according to the present embodiment can be constituted as a monolithic integrated circuit made of circuit elements monolithically integrated on the same semiconductor substrate, such as a microwave monolithic integrated circuit (MMIC) whose schematic cross-sectional view is shown in FIG. 6, for example.

FIG. 6 is the view showing the schematic cross-sectional view of part of the MMIC capable of constituting the variable attenuator according to the present embodiment. In FIG. 6, a GaN HEMT is shown as an example, a reference numeral 61 denoting a substrate (for example SiC), a reference numeral 62 denoting a (high-purity) channel layer (for example, GaN), a reference numeral 64 denoting a carrier supply layer (operation layer), and a reference numeral 63 denoting an insulating layer (for example, $SiO_2$). Further, a reference numeral 65 denotes a wiring to be connected to a drain electrode D, a reference numeral 66 denotes a wiring (for example, a ground wiring) to be connected to a source electrode S, and a reference numeral 67 denotes any wiring. In FIG. 6, a wiring to be connected to a gate electrode G is not shown.

It should be noted that in FIG. 6 the monolithic integrated circuit using gallium nitride is shown as the example but the present embodiment is not limited thereto and the variable attenuator according to the present embodiment can be constituted as a monolithic integrated circuit using any one of indium-phosphorus (InP), gallium arsenide (GaAs) and silicon (Si), for example.

Further, the variable attenuator according to the present embodiment can be constituted as a multi-tip integrated circuit which is made by integrating an active element such as a FET on a semiconductor substrate using GaN, InP, GaAs, and Si, integrating a passive element on an insulating substrate such as an alumina substrate, and mounting the semiconductor substrate on which the active element is integrated and the insulating substrate on which the passive element is integrated.

Figures 7, 8:
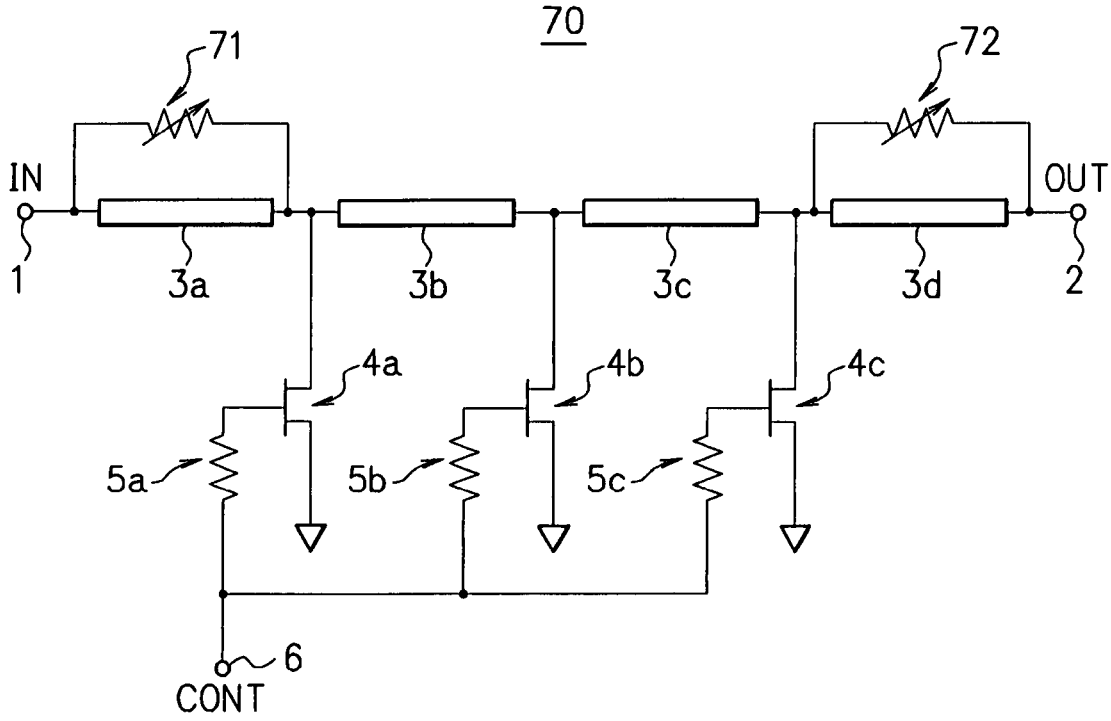
FIG. 7 is a diagram showing another circuitry example of the variable attenuator according to the present embodiment.
FIG. 8 is a table showing an example of transistors applicable to the variable attenuator according to the present embodiment.

FIG. 7 is a diagram showing another circuitry example of a variable attenuator according to the present embodiment. In this FIG. 7, components having the same functions as those of components shown in FIG. 1 are given the same numerals and symbols, and redundant description will be refrained.

A variable attenuator 70 shown in FIG. 7 is constituted similarly to the variable attenuator 10 shown in FIG. 1 and uses variable resistance elements 71, 72 instead of the resistance elements 7, 8 as resistance elements to improve an input/output reflection characteristic by obtaining matching of input and output. The variable resistance elements 71, 72 are constituted with transistors such as FETs, for example. The variable resistance element 71 is connected in parallel to a transmission line 3*a* whose one end is connected to an input terminal 1, while the variable resistance element 72 is connected in parallel to a transmission line 3*d* whose one end is connected to an output terminal 2.

It should be noted that a principle of operation and the like are similar to that of the variable attenuator 10 shown in FIG. 1, and description thereof will be refrained.

In FIG. 8 there is shown an example of a transistor applicable to the variable resistance elements 71, 72 shown in FIG. 7 and the FETs 4*a* to 4*c* functioning as the variable resistance elements in the variable attenuators 10, 70 shown in FIG. 1 and FIG. 7. Assume that, in FIG. 8, symbols given to the transistors shown as the example indicate that applicability becomes lower in an order of a circle, a triangle, and a cross.

Figure 9:
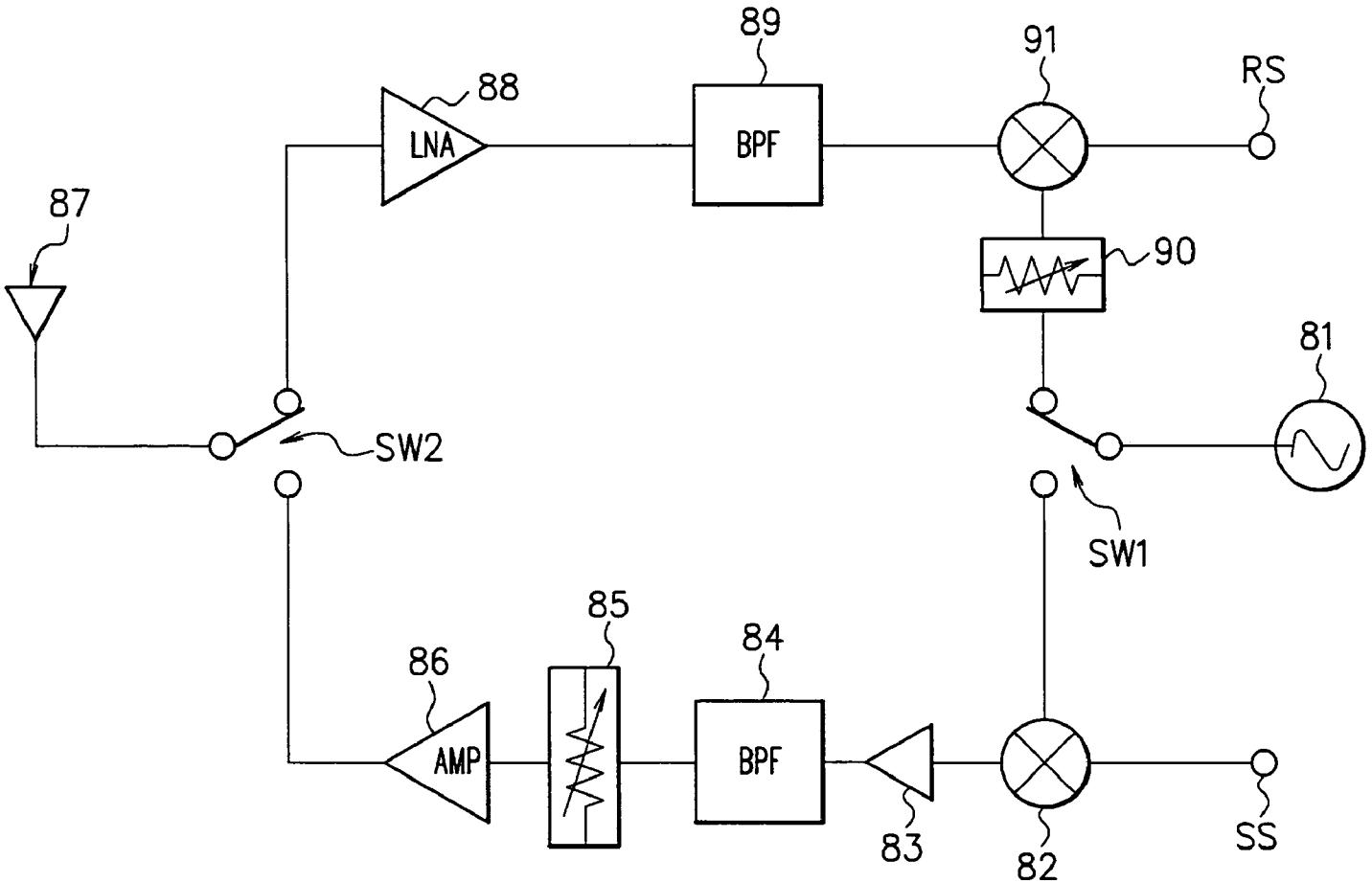
FIG. 9 is a diagram showing a configuration example of a transceiver device using the variable attenuator according to the present embodiment.

FIG. 9 is a diagram showing a configuration example of an RF transceiver device constituted by using the above-described variable attenuator according to the present embodiment.

In FIG. 9, a reference numeral 81 denotes a high-power voltage controlled oscillator (VCO), a reference numeral 82 denotes a mixer (up-converter), a reference numeral 83 denotes a driver, a reference numeral 84 denotes a band pass filter (BPF), a reference numeral 85 denotes a variable attenuator, a reference numeral 86 denotes a high-power amplifier (AMP), and a reference numeral 87 denotes an antenna. Further, a reference numeral 88 denotes a low-noise amplifier (LNA), a reference numeral 89 denotes a band pass filter (BPF), a reference numeral 90 denotes a variable attenuator, a reference numeral 91 denotes a mixer (down-converter), and reference numerals SW1 and SW2 denote SPDT (single pole double throw) switches. Here, as the variable attenuators 85, 90, the above-described variable attenuators according to the present embodiment are used.

A transmission IF signal (intermediate frequency signal) inputted from a transmission signal input terminal SS is converted to a transmission RF signal (high frequency signal) by the up-converter 82 based on an oscillation signal of high-power VCO 81 supplied via the switch SW1. The transmission RF signal outputted from the up-converter 82 is subjected to a filter processing in the BPF 84 via the driver 83 so that an unnecessary frequency component is cut off.

Then, the transmission RF signal outputted from the BPF 84 is attenuated by the variable attenuator 85 by a predetermined attenuation amount to be adjusted in output level, and further amplified by the AMP 86. The transmission RF signal amplified by the AMP 86 is supplied to the antenna 87 via the switch SW2 and transmitted from the antenna 87.

Here, in order to increase output of the RF transceiver device shown in FIG. 9, it is indispensable to increase output of the AMP 86. However, the output required for the transmission depends on weather or environment at the time and the maximum output as the device is not always required. Hence, by providing the above-described variable attenuator according to the present embodiment in a transmission side, the adjustment of the output level can be performed.

Further, a reception RF signal received by the antenna 87 is supplied to the LNA 88 via the switch SW2 and amplified by the LNA 88. The reception RF signal amplified by the LNA 88 is subjected to a filtering processing in the BPF 84 and thereafter supplied to the down-converter 91.

The reception RF signal supplied to the down-converter 91 is converted to a reception IF signal by the down-converter 91, based on a local oscillation signal based on the oscillation signal of the high power VCO 81, and outputted from a reception signal output terminal RS. It should be noted that the local oscillation signal supplied to the down-converter 91 is a signal made by attenuating the oscillation signal of the high power VCO 81 in the variable attenuator 85 by a predetermined attenuation amount.

Here, in order to increase the output of the RF transceiver device, it is also necessary to use a high power VCO. However, the oscillation signal of the high power VCO 81 is used also for down-converting the reception RF signal in the down-converter 91, and if the output is too large, inconveniences may occur in a reception side processing. Hence, by providing the variable attenuator according to the present embodiment between the high power VCO 81 and the down-converter 91, it is possible to perform a level adjustment of the local oscillation signal supplied to the down-converter 91.

It should be noted that in FIG. 9 there is shown the RF transceiver device using the variable attenuators according to the present embodiment in both of the transmission side and the reception side, but it is also possible that the variable attenuator according to the present embodiment is applied to either one of the transmission side or the reception side.

The present embodiments are to be considered in all respects as illustrative and o restrictive, and all changes which come within the meaning and range of equivalency of the claims are therefore intended to be embraced therein. The invention may be embodied in other specific forms without departing from the spirit or essential characteristics thereof.

INDUSTRIAL APPLICABILITY

As stated above, according to the present invention, resistance elements to improve an input/output reflection characteristic are connected in parallel to transmission lines connected to an input terminal and an output terminal. Hereby, without deteriorating the input/output characteristic in a variable attenuator, it is possible to increase an attenuation amount compared with conventionally possible, so that a maximum attenuation amount can be improved while a good input/output characteristic is held.

What is claimed is:

1. A variable attenuator comprising:

a plurality of quarter wavelength transmission lines connected in series between an input terminal and an output terminal;

a plurality of transistors provided in correspondence with interconnection points between said plurality of transmission lines, in each of said transistor a drain being connected to the interconnection point of said transmission lines, a source being earthed, and control voltage being supplied to a gate;

a first resistance element connected in parallel to said transmission line connected to the input terminal; and a second resistance element connected in parallel to said transmission line connected to the output terminal.

2. An integrated circuit comprising:

a semiconductor substrate on which an active element of the variable attenuator according to claim 1 is integrated; and an insulating substrate on which a passive element of the variable attenuator is integrated.

3. An integrated circuit wherein each circuit element constituting the variable attenuator according to claim 1 is monolithically integrated on the same semiconductor substrate.

4. The variable attenuator according to claim 1, wherein at least one of said first resistance element and said second resistance element is a variable resistance element.

5. The variable attenuator according to claim 4, wherein said variable resistance element is constituted using a transistor.

6. The variable attenuator according to claim 4, wherein said variable resistance element is constituted using an HEMT (high electron mobility transistor).

7. The variable attenuator according to claim 4, wherein said variable resistance element is constituted using an HBT (hetero-junction bipolar transistor).

8. An integrated circuit comprising:

a transmission side mixer converting an intermediate frequency signal to a high frequency signal;

a transmission side variable attenuator of which an attenuation amount is adjustable and which attenuates and outputs the high frequency signal outputted from said transmission side mixer; and a transmission side amplifier amplifying and outputting to an antenna the high frequency signal outputted from said transmission side variable attenuator, wherein said transmission side variable attenuator includes a plurality of quarter wavelength transmission lines connected in series between an input terminal and an output terminal, a plurality of transistors provided in correspondence with interconnection points between said plurality of transmission lines, in each of said transistor a drain being connected to the interconnection point of said transmission lines, a source being earthed, and control voltage being supplied to a gate, a first resistance element connected in parallel to the transmission line connected to the input terminal, and a second resistance element connected in parallel to the transmission line connected to the output terminal.

9. The integrated circuit according to claim 8, comprising:

a reception side amplifier supplied with a high frequency signal received by the antenna, and amplifying and outputting the high frequency signal;

a reception side variable attenuator of which an attenuation amount is adjustable and which attenuates and outputs a local oscillation signal; and a reception side mixer converting the high frequency signal outputted from the reception side amplifier to an intermediate frequency signal, based on the local oscillation signal outputted from said reception side variable attenuator, wherein said reception side variable attenuator includes a plurality of quarter wavelength transmission lines connected in series between an input terminal and an output terminal, a plurality of transistors provided in correspondence with interconnection points between said plurality of transmission lines, in each of said transistor a drain being connected to the interconnection point of said transmission lines, a source being earthed, and control voltage being supplied to a gate, a first resistance element connected in parallel to the transmission line connected to the input terminal, and a second resistance element connected in parallel to the transmission line connected to the output terminal.

10. An integrated circuit comprising:

a reception side amplifier supplied with a high frequency signal received by an antenna, and amplifying and outputting the high frequency signal;

a reception side variable attenuator of which an attenuation amount is adjustable and which attenuates and outputs a local oscillation signal; and a reception side mixer converting the high frequency signal outputted from the reception side amplifier to an intermediate frequency signal, based on the local oscillation signal outputted from said reception side variable attenuator, wherein said reception side variable attenuator includes a plurality of quarter wavelength transmission lines connected in series between an input terminal and an output terminal, a plurality of transistors provided in correspondence with interconnection points between said plurality of transmission lines, in each of said transistor a drain being connected to the interconnection point of said transmission lines, a source being earthed, and control voltage being supplied to a gate, a first resistance element connected in parallel to the transmission line connected to the input terminal, and a second resistance element connected in parallel to the transmission line connected to the output terminal.

* * * * *